US008162365B2

(12) United States Patent
Escobar

(10) Patent No.: US 8,162,365 B2
(45) Date of Patent: Apr. 24, 2012

(54) EMERGENCY RESCUE DEVICE

(76) Inventor: John Armando Escobar, Sheboygan, WI (US)

( * ) Notice: Subject to any disclaimer, the term of this patent is extended or adjusted under 35 U.S.C. 154(b) by 91 days.

(21) Appl. No.: 12/841,295

(22) Filed: Jul. 22, 2010

(65) Prior Publication Data

US 2011/0018293 A1 Jan. 27, 2011

Related U.S. Application Data

(60) Provisional application No. 61/228,227, filed on Jul. 24, 2009.

(51) Int. Cl.
*A61G 1/00* (2006.01)

(52) U.S. Cl. ..... 294/140; 441/84

(58) Field of Classification Search ..... 294/140, 294/150; 441/80, 84, 85; 182/70
See application file for complete search history.

(56) References Cited

U.S. PATENT DOCUMENTS 4,713,033 A * 12/1987 Cameron ..... 441/84
6,257,942 B1 * 7/2001 Groover ..... 441/84
6,516,920 B1 * 2/2003 Schafler ..... 182/70
6,575,799 B1 6/2003 Stimpson et al.
6,679,743 B1 1/2004 Gerber
6,800,007 B2 10/2004 Calkin
6,880,702 B1 * 4/2005 Colorado ..... 206/388
7,285,032 B2 10/2007 Cha
2002/0102891 A1 * 8/2002 Anderson et al. ..... 441/80
2006/0076186 A1 * 4/2006 Lindqvist ..... 182/70

* cited by examiner

*Primary Examiner* — Saul Rodriguez
*Assistant Examiner* — Gabriela Puig
(74) *Attorney, Agent, or Firm* — Steven H. Greenfield Greenfield Invention and Patent Consulting, Jr.

(57) ABSTRACT

A device and method for moving a person who is in distress or incapacitated are disclosed. The device comprises a receptacle in which a long rescue strap is contained. A short segment of one end of the strap exits the receptacle through an aperture in the receptacle where it is attached to a spring hook. Blocking members inside and outside the receptacle prevent sliding of the rescue strap inside and outside the receptacle. The other end of the strap is sewn into an adjustable loop that a rescuer may tightly strap onto his/her wrist. The method comprises tossing the receptacle toward the victim as the rescuer grips the adjustable loop, unwinding the strap from the bag, attaching the spring hook to the victim and pulling the victim to safety.

11 Claims, 12 Drawing Sheets

EMERGENCY RESCUE DEVICE

RELATED APPLICATIONS

This application claims priority from provisional application number 61/228,227 filed on Jul. 24, 2009.

FIELD OF THE INVENTION

The present invention generally relates to a device and method for moving a person who is in distress or incapacitated. More specifically the present invention relates to an emergency rescue bag for rescuing persons who are incapacitated and/or trapped in areas from which normal rescue is difficult as these areas might be inaccessible to rescue personnel. As examples, an injured firefighter might be trapped in a basement and inaccessible because of fire or smoke, an injured policeman might be inaccessible to rescue personnel by normal means because of gun fire hampering the rescue operation, a hiker might be incapacitated in a narrow ravine, or an ice fisherman might have fallen through the ice.

BACKGROUND OF THE INVENTION

Prior art references disclose a variety of rescue devices. A rescue bag described in U.S. Pat. No. 4,713,033 comprises a pair of looped straps having their ends fixedly attached to a bag end wall. The bag also comprises a handle portion and a pair of lengthwise extending portions slidably attached to the bag sidewall toward the bag open end. The looped straps can be pulled outward from the bag sidewall to form arm loops. In an alternative embodiment, a locking clip can be attached to the strap handle portions so that the straps can be extended around the person to be rescued and locked to provide a rescue harness. U.S. Pat. No. 6,257,942 relates to a glow-in-the-dark rescue line throw-bag for use in day or nighttime water rescue operations. The glow-in-the-dark rescue throw-bag comprises a receptacle portion having a see-through sidewall surrounding a rope storage volume. The see-through sidewall extends to a closed end formed by an end wall and has an open end opposite the closed end leading into the rope storage volume. The throw-bag further comprises a phosphorescent rope line having a first end fixedly attached to the receptacle. An elongated body portion of the phosphorescent rope line is loosely stored within the rope storage volume when not in use, and viewable through the see-through sidewall of the receptacle. U.S. Pat. No. 6,575,799 teaches an emergency rescue device that stores conveniently and provides a rapid deployment. The invention comprises a length of rope interconnected to a weighted throwing unit having a loop portion with an automatic restraining system that consists of a loop forming assembly that engages the rope and forms an adjustable loop in the rope, in a way that the loop provides resistance on the rope to maintain the size of the adjustable loop and the means for providing no resistance when said base end is pulled. The throwing unit is used to position the loop in close proximity to the distressed person, wherein the person only needs to insert his/her hands within the loop. The rescue personnel pull the rope which tightens the loop and firmly holds the wrists of the person in a hyper extended position. U.S. Pat. No. 6,659,823 discloses a dispenser for a safety throw rope made from a rigid hollow body that defines a cavity having a bung hole at one end and a looped hollow handle portion at another end spaced from the bung hole. A length of rope is received in the cavity and is coupled to a closure assembly for closing the bung hole. The other end of the rope is looped around the handle portion inside the cavity and coupled to the handle portion so that the body may be thrown and the rope will pay out of the bung hole in a rescue situation. U.S. Pat. No. 6,679,743 refers to safety throw bag having a bottom with a bottom opening. A float is having an opening positioned in the bag. A cord having opposite ends extends through the float and the float is positioned in the bag between the opposite ends to partition the bag into a first cord section and a second harness section. An over-the-shoulder harness is secured to the cord at one end. The harness is stored in the section adjacent the bag bottom and on the opposite side of the float from the cord section. The bag has a weight with the harness and float in the bag such that the bag may be thrown to a person in peril. The harness may be attached to the person in peril and the person in peril may be pulled to safety by the cord. U.S. Pat. No. 6,800,007 provides a personal throw bag lifeline rescue apparatus in the form of a lifeline-containing pouch which is arranged to be attached in quick release fashion to the wearing apparel of rescue and military personnel with the free terminal end of the lifeline being securely attached to the safety apparel of the wearer whereby in an emergency, the throw bag may be grasped and immediately pulled from its releasable attachment to the wearer and thrown, carried or otherwise moved to a remote location where another person may grab the lifeline and pull the person to safety by virtue of the fixed securement of the lifeline to the safety harness or other safety apparel worn by the personnel from whom the throw bag had been removed. U.S. Pat. No. 7,285,032 is for a hand thrown flying disk used in rescuing individuals in distress comprising of a length of line of which one end is connected to an anchoring clip and a handle. With the use of double-sided adhesive pads, the other end is spirally wound on top of the cover and the disk. A loop is attached to the line which allows for the removal of the cover when the disk is thrown. The end of the line is then fed through the hole on the top and then terminated by weaving it through the holes on the side. The end is secured by tucking the end into the weaving. The hole provides for an easy grabbing point. US Pre-grant Publication number 20060076186 reveals a life-saving device that comprises a storage unit, an opening arranged at one end of the storage unit, a rope attached to the storage unit, the rope being received inside the storage unit when the rope is in inactive position, a weight and a floating body that a closed lifting loop is connected to the rope or that in the area of the end of the storage unit that faces away from the opening a fastening element is connected to the rope, the fastening element having a coupling function and may be detachably engaged with the rope.

While most rescue devices described in the prior art references attempt to rescue a person in distress or incapacitated, their configuration appears excessively complex which makes rescuing the distressed person less effective.

SUMMARY OF THE PRESENT INVENTION

In one aspect of the present invention, a device for moving incapacitated persons comprises: a receptacle having an inside and an outside, the receptacle having a top opening, the receptacle having opening and closing means, the receptacle also having a sidewall containing an aperture; a rescue line having a first end and a second end, the rescue line being adapted for folding, winding, unwinding and placing on the inside of the receptacle, the first end of the rescue line being formed into an adjustable loop, the second end of the rescue line being threaded through the aperture from the inside of the receptacle; and a second loop being attached to the second end of the rescue line.

In another aspect of the present invention, a method for moving an incapacitated person comprises: providing a device for moving incapacitated persons, said device comprising a receptacle, said receptacle having an inside and an outside and a top opening, said receptacle also having a flap for opening and closing the device, said receptacle also having a sidewall containing an aperture, said device also comprising a rescue line having a first end and a second end, said rescue line being adapted for folding, winding, unwinding and placing on the inside of the receptacle, said first end of the rescue line being formed into a tightening loop, a sliding loop and an adjustable loop, said second end of the rescue line being threaded through the aperture from the inside of the receptacle, said rescue line also containing a second loop being attached to said second end of said rescue line, said device also comprising a draw string for tightening the top opening; with the rescue line wound inside the receptacle, opening the flap and loosening the draw string; pulling out the adjustable loop from the receptacle; wrapping the adjustable loop around a substantially fixed object; adjusting the tightening loop and the sliding loop to tighten the adjustable loop around the fixed object; with the adjustable loop wrapped around the substantially fixed object, throwing the receptacle containing the wound rescue line toward the incapacitated person; unwinding the rescue line from the bag; when the receptacle reaches the incapacitated person, attaching the second loop to the incapacitated person; and pulling the incapacitated person to a secure area.

These and other features, aspects and advantages of the present invention will become better understood with reference to the following drawings, description and claims.

DETAILED DESCRIPTION OF THE INVENTION

Figure 1:
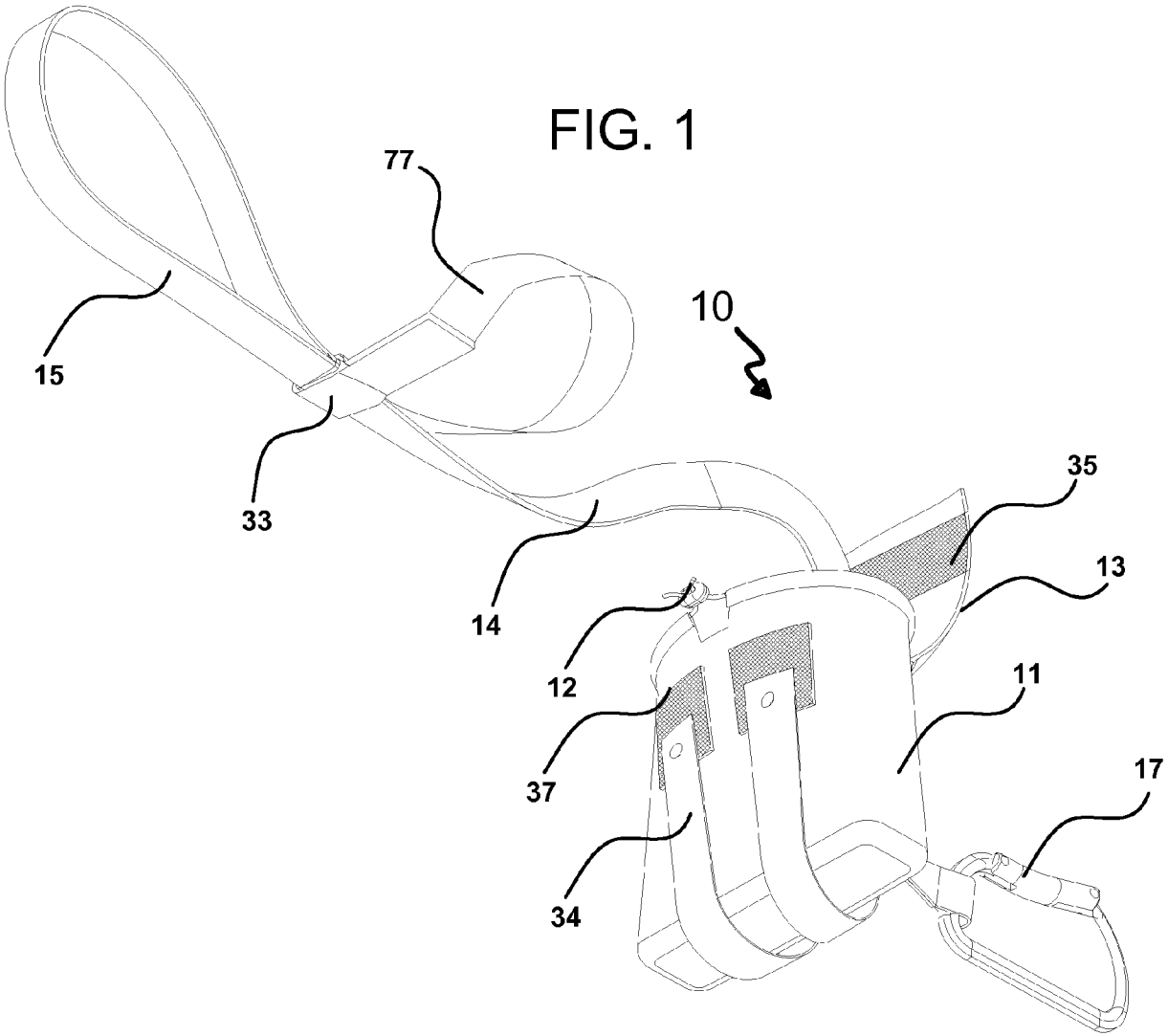
FIG. 1 is a bottom front perspective view of the open device according to an embodiment of the present invention.
Figure 2:
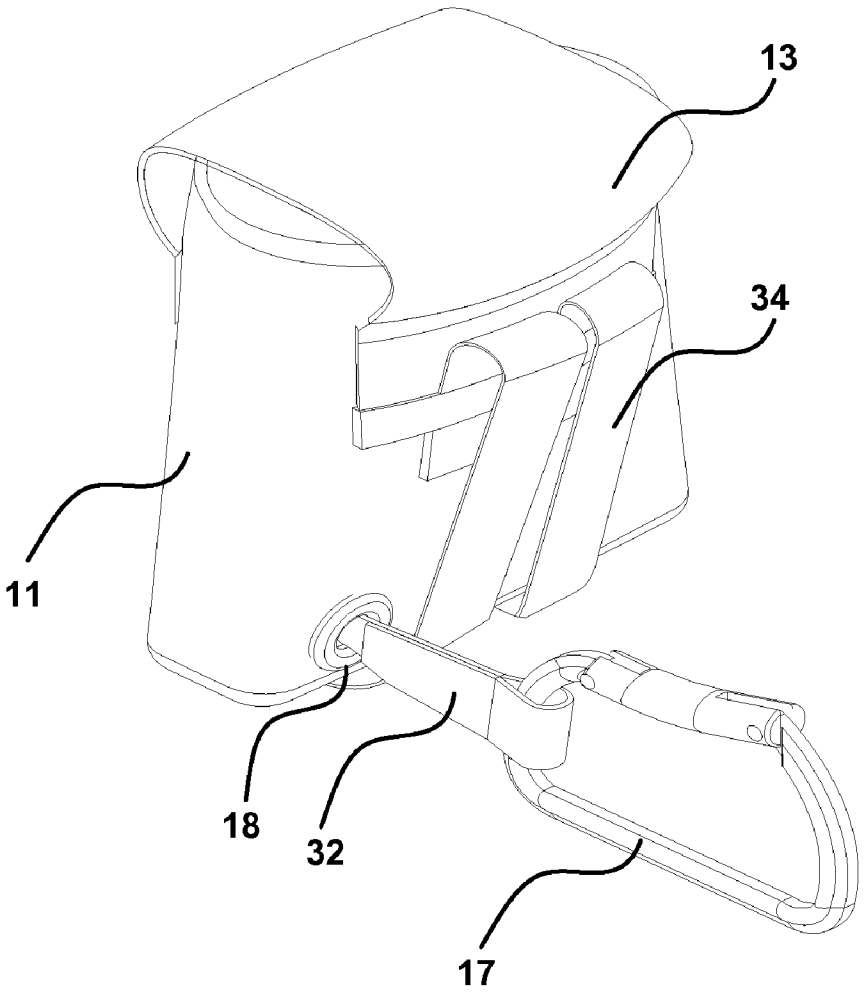
FIG. 2 is a rear side perspective view of the closed device according to an embodiment of the present invention.
Figure 3:
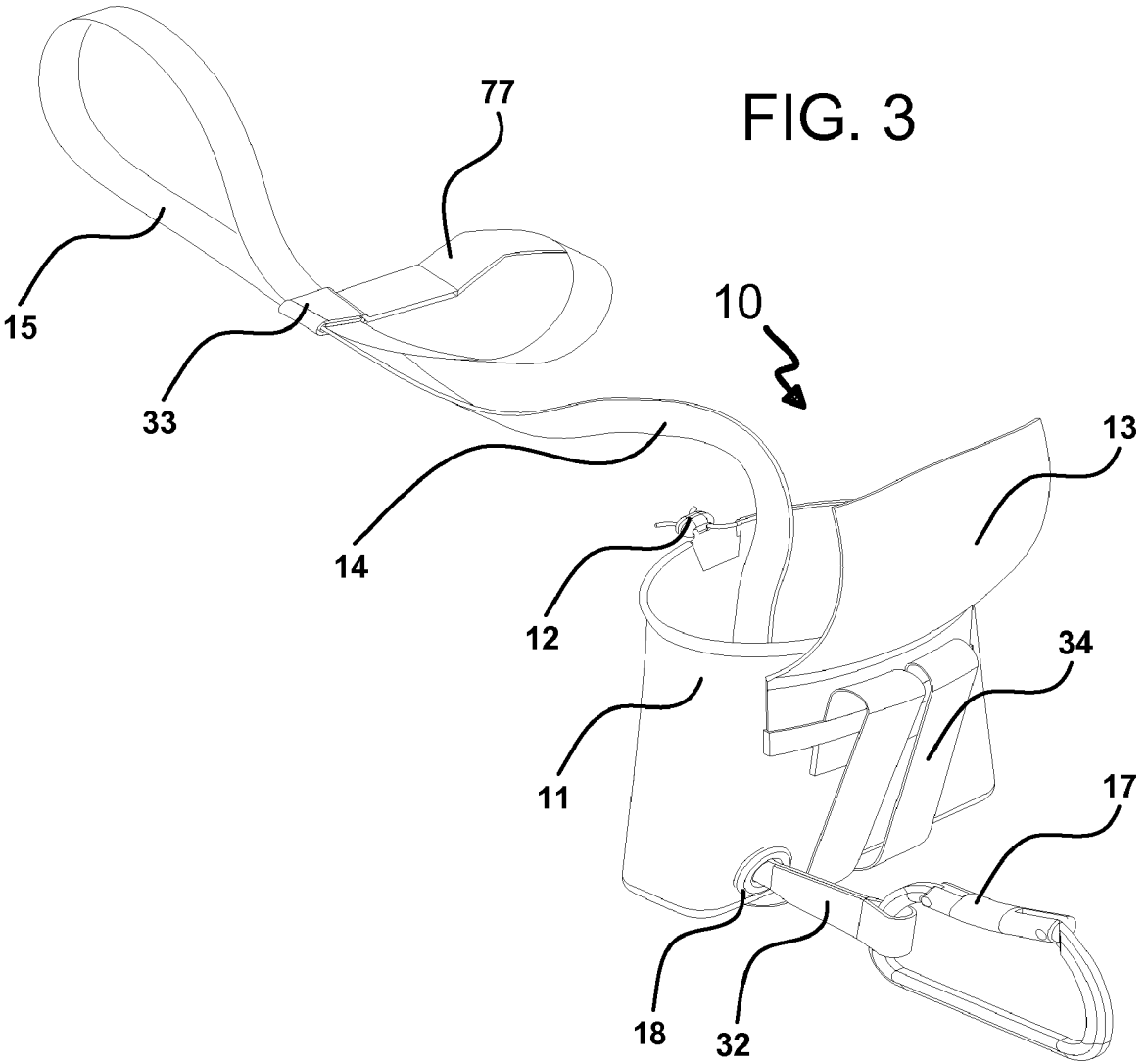
FIG. 3 is a rear side perspective view of the open device according to an embodiment of the present invention.
Figure 4:
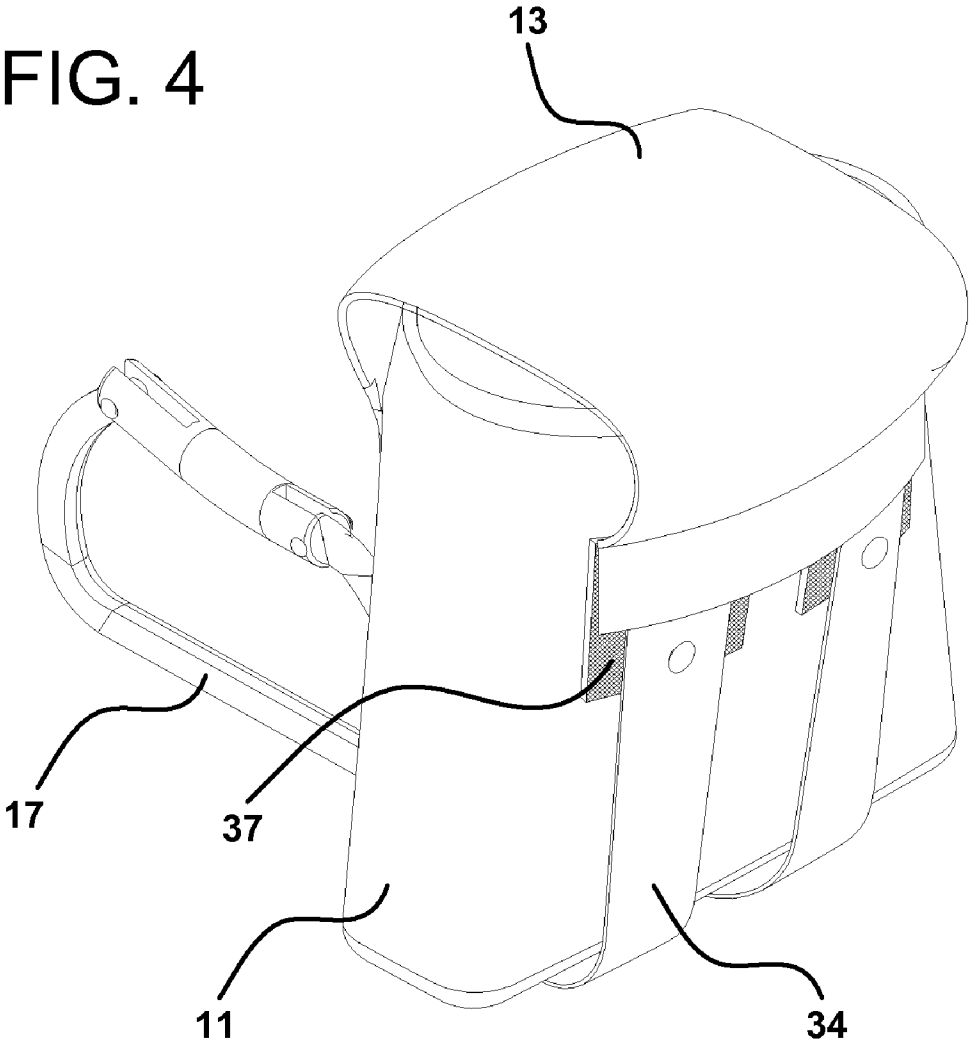
FIG. 4 is a front side perspective view of the closed device according to an embodiment of the present invention.
Figure 5:
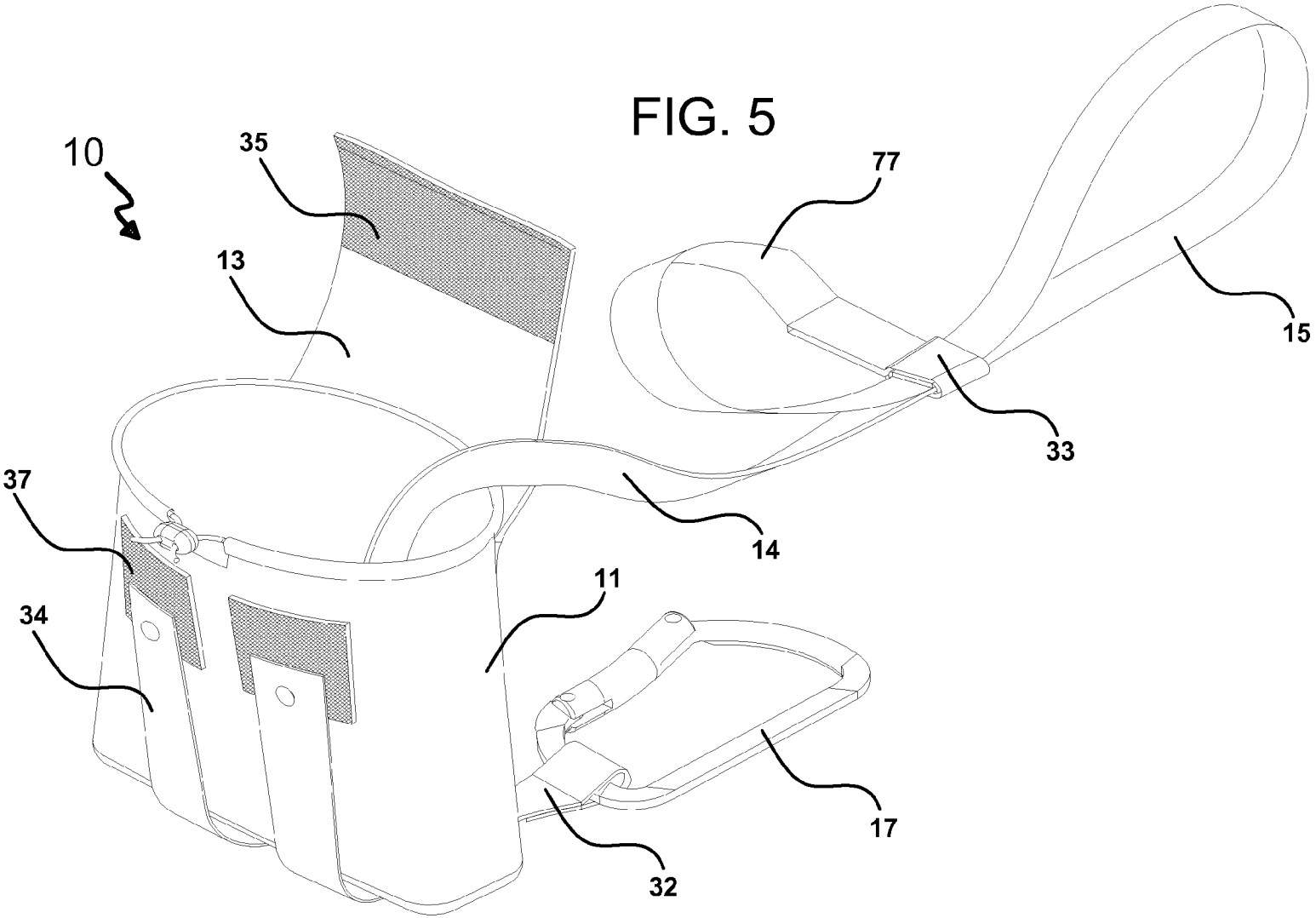
FIG. 5 is a front side perspective view of the open device according to an embodiment of the present invention.
Figure 6:
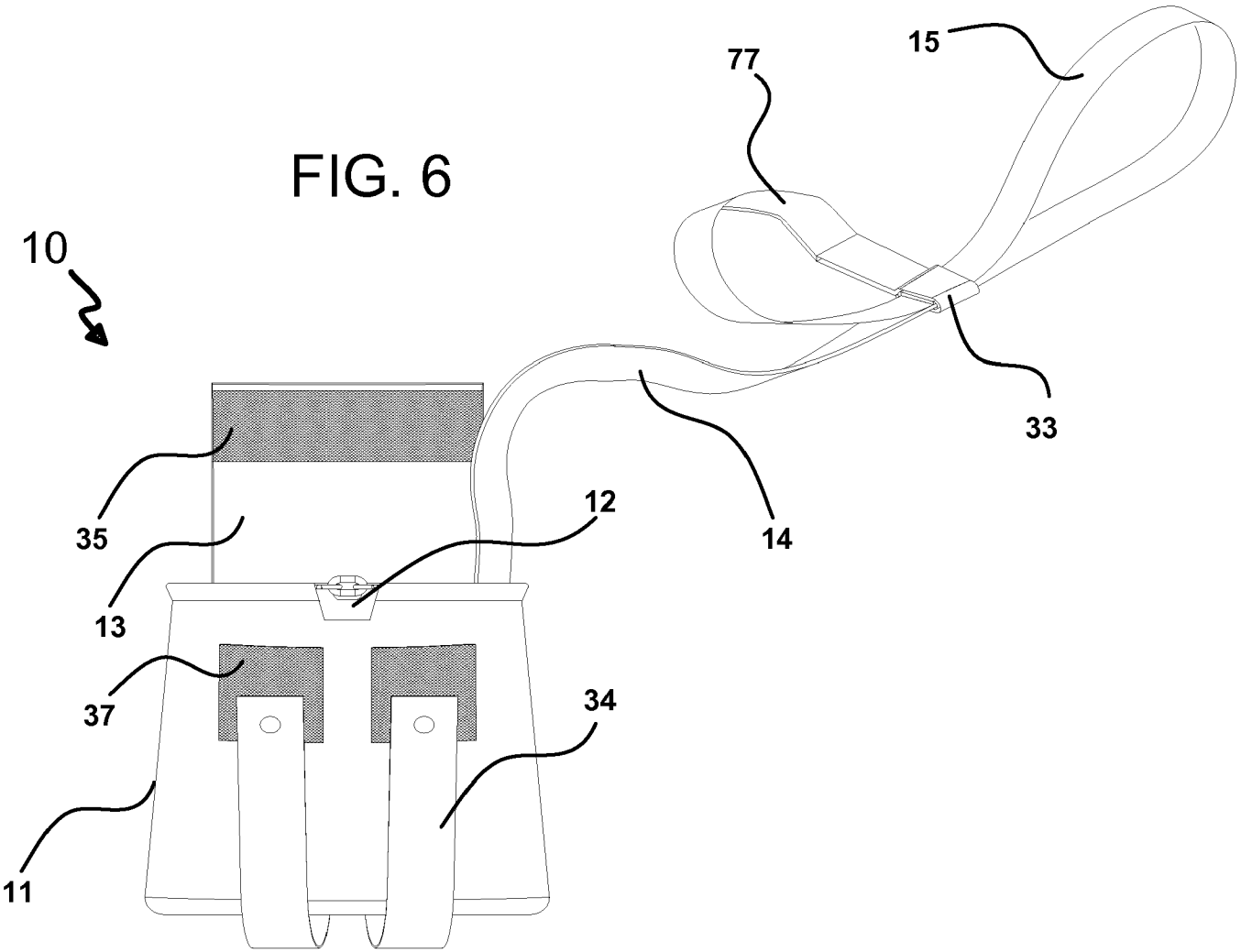
FIG. 6 is a front view of the open device according to an embodiment of the present invention.
Figure 7:
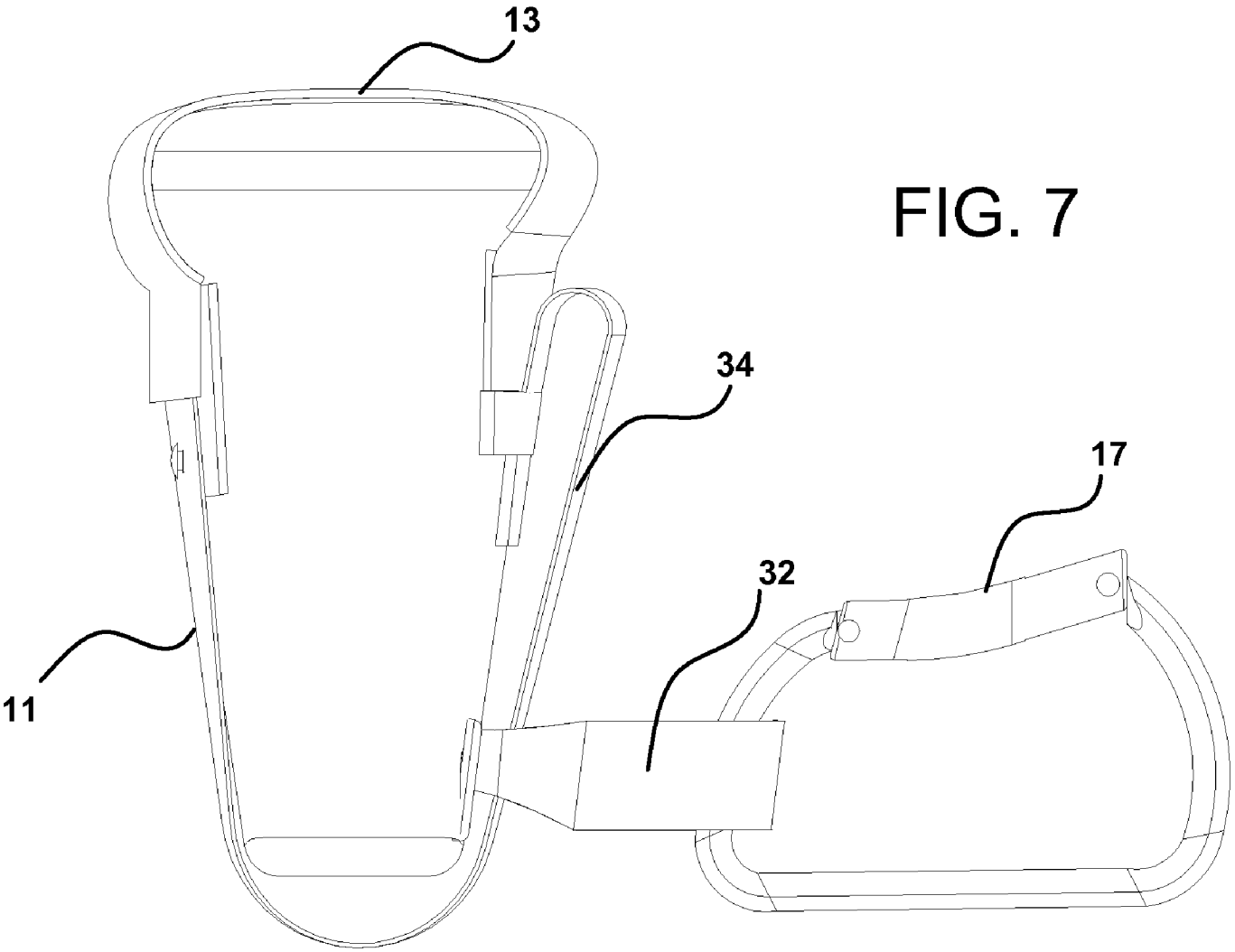
FIG. 7 is a side view of the closed device according to an embodiment of the present invention.
Figure 8:
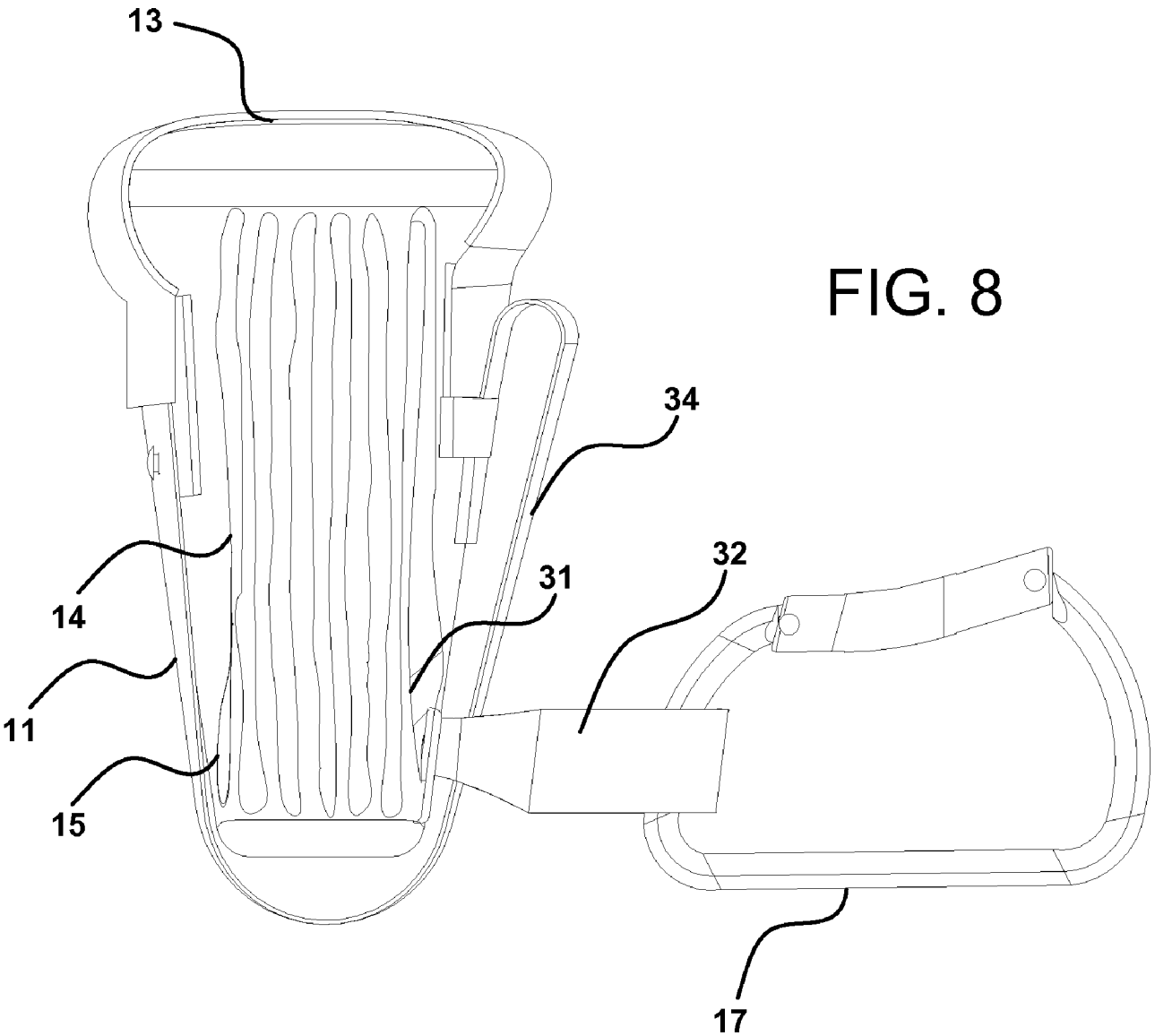
FIG. 8 is a side cross sectional view of the closed device according to an embodiment of the present invention showing a strap wound inside the device.
Figure 9:
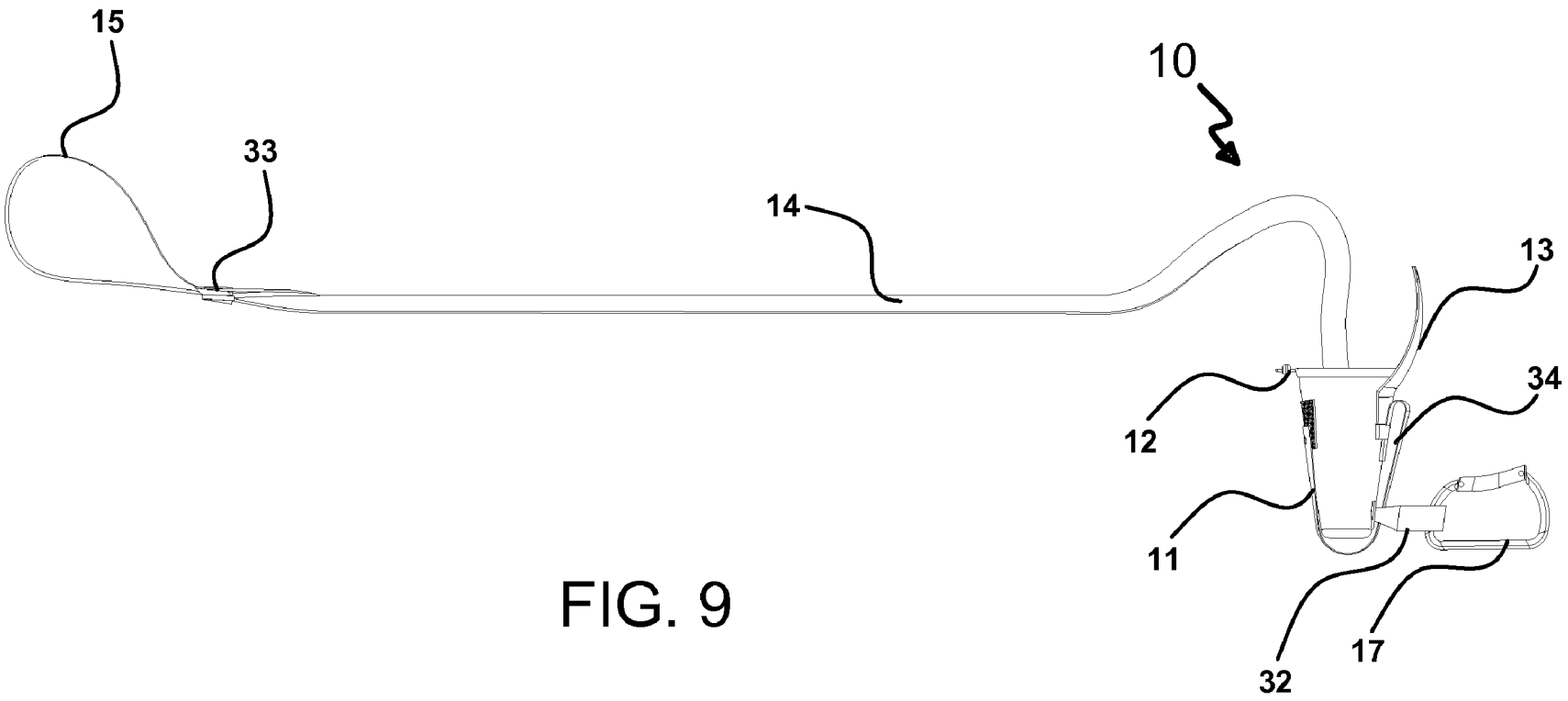
FIG. 9 is a side view of the open device according to an embodiment of the present invention.
Figure 10:
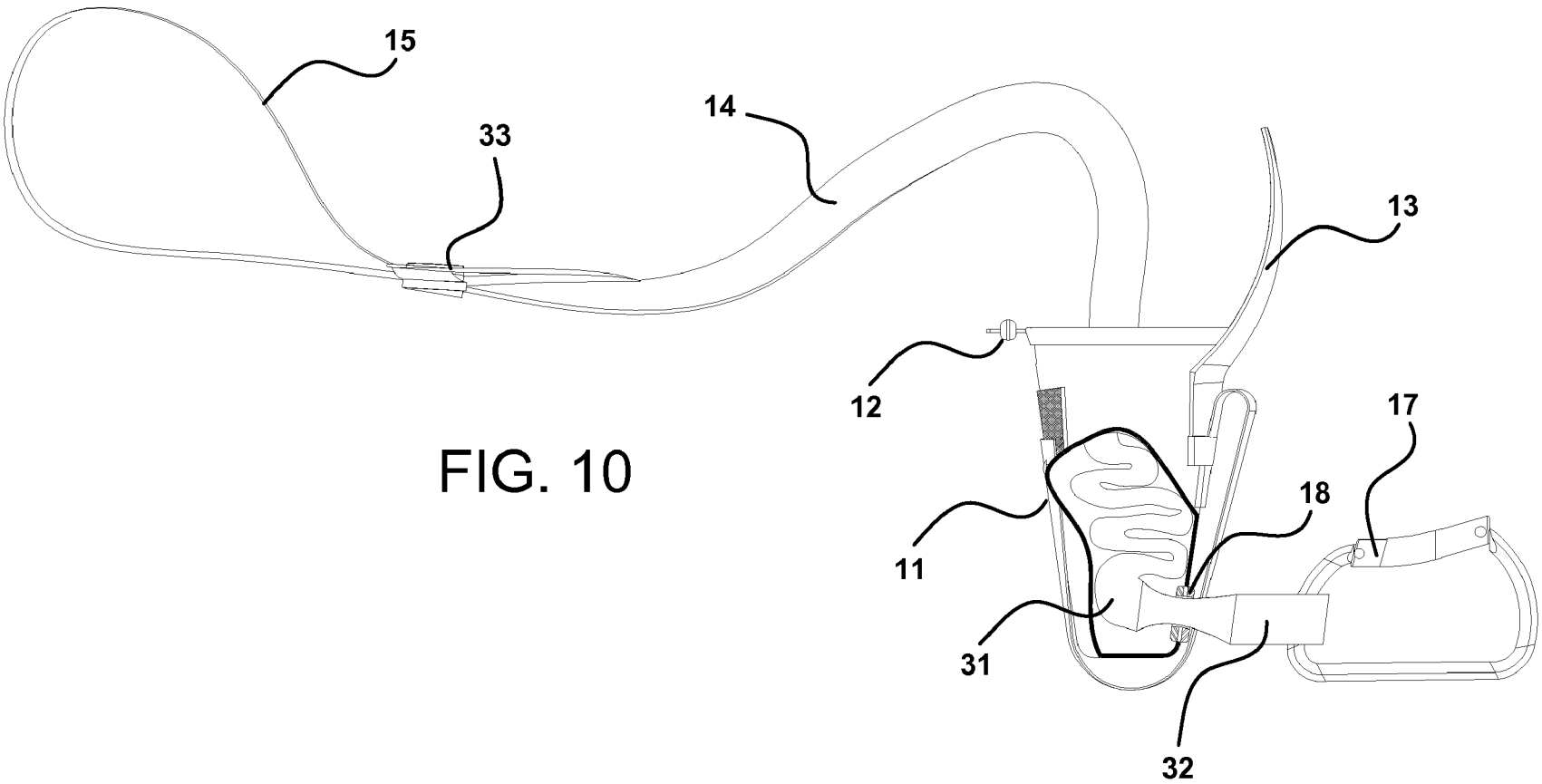
FIG. 10 is a side cross sectional view of the open device according to an embodiment of the present invention showing a strap wound inside the device.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

In one aspect, the present invention comprises a receptacle having an inside compartment and a top opening used for storing a long strap. The receptacle that, in a preferred embodiment, comprises a sturdy bag may be carried by personnel charged with rescuing individuals such as police, army medics or fire fighters. As such, the bag is equipped with means for attachment to other objects for stowing purposes when not in use. These objects include but are not limited to a rescuer's belt, a part of clothing, or an object in the field. The strap may be folded and wound inside the bag in various patterns such as a horizontal pattern, a vertical pattern or winding in a ball; however the user may find a specific pattern that maximizes the use of the existing space inside the bag.

The bag comprises a flap for covering the top opening in order to keep the long strap from falling out. The flap has a hook and loop arrangement such as Velcro® sewn onto the front bottom part of the flap. This hook and loop is adapted to attach to a hook and loop counterpart sewn onto the bag. The bag may optionally contain a draw string to insure a tight closure of the top opening. In an embodiment of the present invention, there are two attachment straps attached to the front and to the back of the bag at the point of the flap's attachment. These straps, sewn to the bag using military grade webbing, may be used to attach the bag to military modular lightweight load-carrying equipment system, referred to in the professional jargon as MOLLE, or a law enforcement officer's belt and can be released using snap buttons.

The side wall of the bag comprises an aperture through which a short segment of the long strap stored inside the bag exits the bag. The aperture may be in a form of a metallic ring such as a grommet, but other types of apertures also fall within the scope of the present invention. The short strap segment exiting the bag is attached to a spring hook such as a karabiner. The other end of the strap, typically stored in the bag when not in use, comprises an adjustable loop formed in a manner that allows adjusting the loop size and tightness. This may be accomplished by forming a sliding loop sewn onto the strap and winding out extra strap for tightening or loosening the adjustable loop.

The bag, straps, and flap may be made of nylon, neoprene or other strong materials. The bag may be deployed by a rescuer to a conscious and/or non-mobile victim in situations where movement to safety is more vital than treating the victim in place due to dangerous factors surrounding the victim e.g. gunfire or drowning. The operator holds onto one end of the strap via an adjustable wrist loop, and throws or tosses the bag filled with the strap toward the victim. The attached karabiner can be held on to or attached to the belt of the victim, and the rescuer then pulls the victim to the safety of cover. Additionally, the karabiner may be used to tow small recreational vehicles like ATVs, snowmobiles, and personal watercrafts.

A typical embodiment of the present invention depicts a 1000 denier or 500 denier nylon bag with approximate dimensions 6"×6"×1" when empty, 4"×3.5"×5" when filled, and a 6.5"×4.5" flap sewn onto the back of the bag that folds over the top of the bag to the front. Inside the bag is stored 35 to 150 feet of military spec nylon strap with sewn 1" end loops on both ends. It should be noted that the size of the bag increases as the length of the strap increases. The two attachment straps are partially attached to the back of the bag at the point of the flap's attachment. These straps, sewn to the bag using military grade webbing, may be used to attach the bag to a military modular lightweight load-carrying equipment system or a law enforcement officer's belt and can be released using snap buttons. Due to the restricted space surrounding a bag attached to MOLLE or an officer's duty belt, the snap buttons are located on the front of the bag below the Velcro®. This allows the bag to be either on top of or next to another piece of equipment and still allow the operator access to releasing the buttons and thus the straps.

One end of the long tubular webbing protrudes about 3" out of the bag through a 1" metal grommet, inside the bag on the tubular webbing an inner blocking member is sewn so the webbing does not feed out of the grommet. That end of tubular webbing has a karabiner attached through the 1" end loop. Between the Karabiner and the grommet, an outer blocking member is sewn to the tubular webbing to prevent the karabiner to be pulled into the grommet. The opposite end of tubular webbing has an adjustable loop to be secured around the operator's wrist, formed by feeding a section of webbing through the 1" end loop. To prepare the bag, the tubular webbing is fed into the bag through the top opening in a zigzag pattern, completely filling the bag. A draw-string fastener is pulled to constrict the top of the bag. The military parachute cord draw-strings are secured with a spring type two-hole cord lock. The flap is then pulled across the top of the bag and secured to the front with Velcro®.

To deploy the bag, if it is secured to a belt or MOLLE system then the user first detaches the bag by releasing the two attachment straps from the two snap buttons. The user then opens the flap, exposing the long nylon strap and adjustable loop. Securing the loop around the wrist of his or her throwing hand and holding the bag like a softball, the user then can toss, under-hand throw, over-hand throw, side-arm throw, or lob the bag with as much force as is needed to reach the intended target. The strap will deploy out of the bag en route to the victim. Once the bag and karabiner has reached the victim, the victim can attach the karabiner to an attachment point on themselves, e.g. a military victim can attach to their tactical vest or casualty strap on their flak vest, a law enforcement officer can attach it to their gun belt and hang on to strap with hand at chest, and civilian and all categories can form a loop with the karabiner and secure it around his or her ankles or simply hang on to the loop. Once the victim is secure to the karabiner, the user can drag the victim to the safety of cover.

The primary benefit of the present invention is that it permits rescuers to save victims from danger without jeopardizing the safety of the rescuer. In many real-world situations, a shooting victim has fallen into a conscious state but is unable to move.

Figure 11:
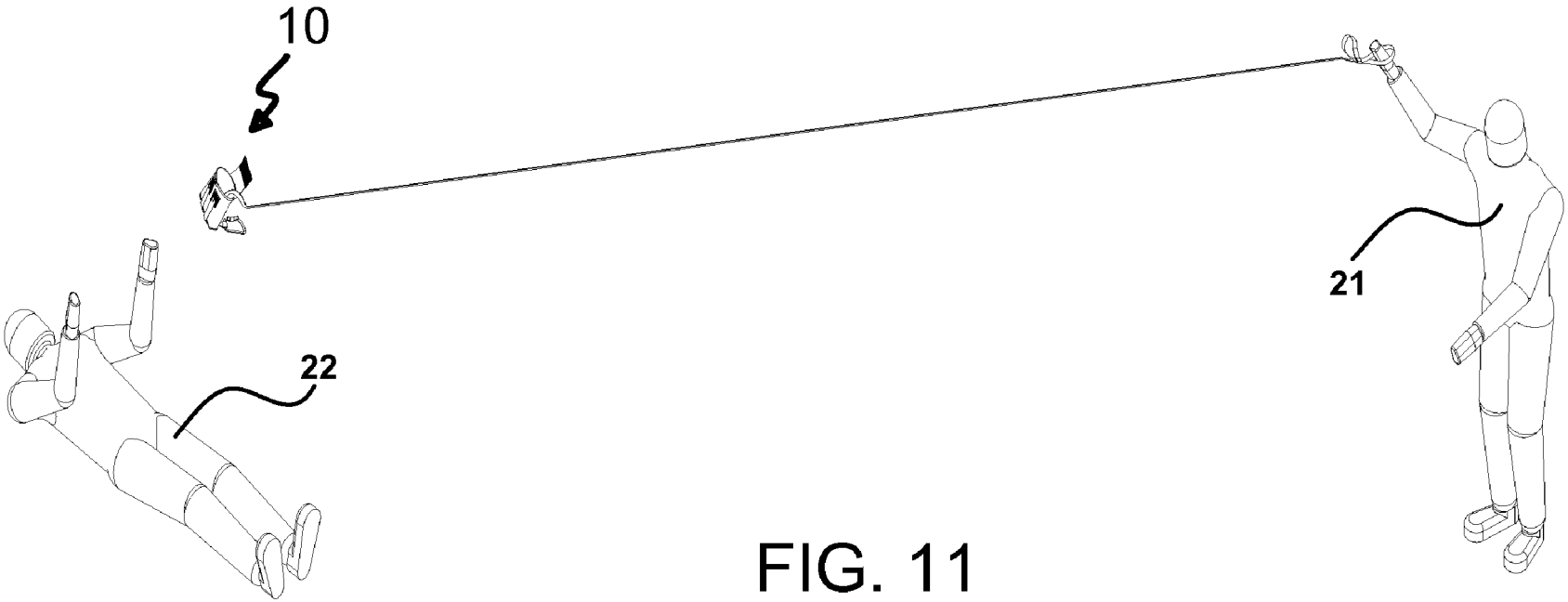
FIG. 11 is a depiction of the device in use according to an embodiment of the present invention.
Figure 12:
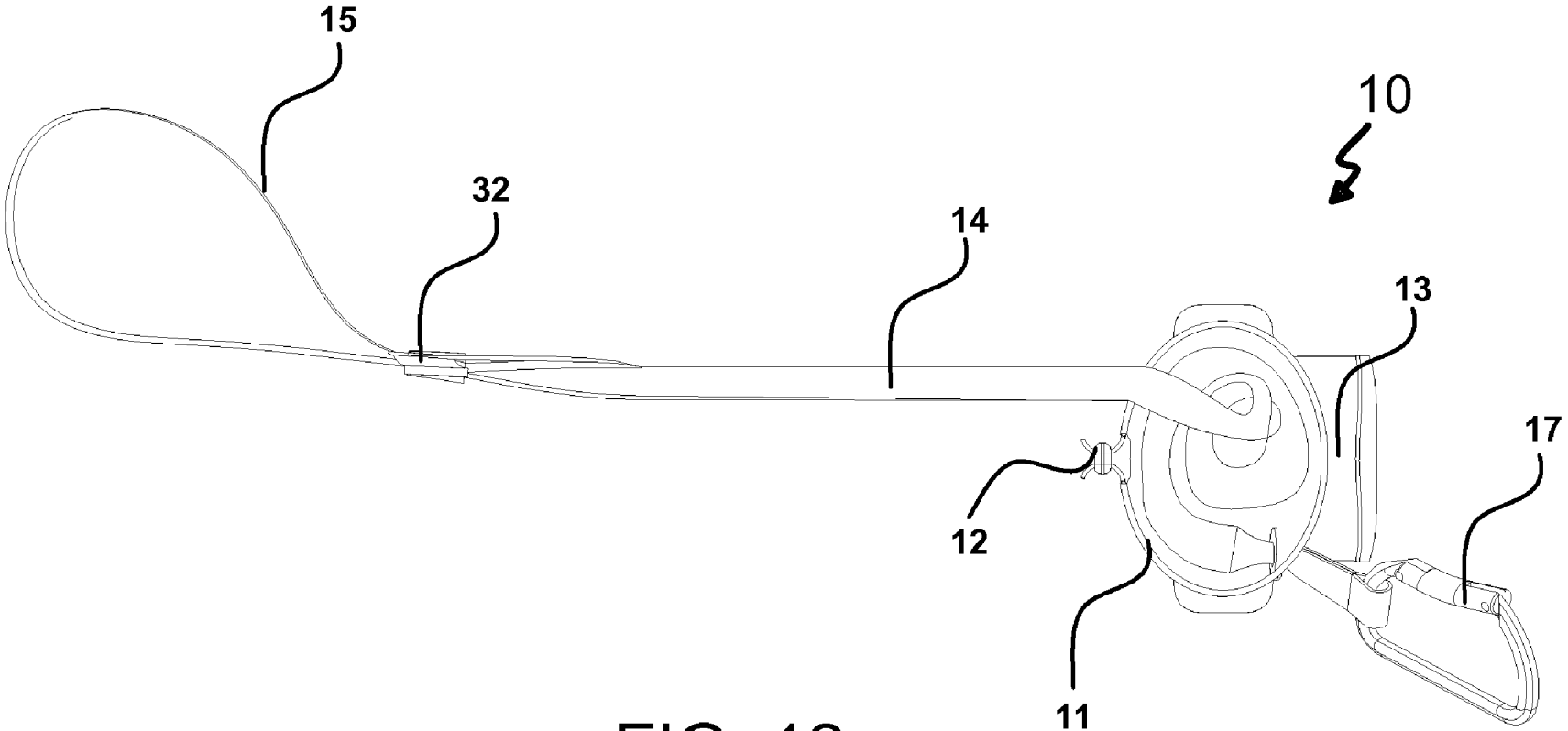
FIG. 12 is a top view of the open device according to an embodiment of the present invention showing a strap wound inside the device.

The invention is represented in FIGS. 1-12. Shown are the bag 10 enclosed by a wall 11 and having a flap 13 for closing and opening the bag. The bag also comprises a draw string 12, a grommet 18, a Velcro® sewn onto the flap 35, Velcro® sewn onto the bag 37 and securing straps 34 for carrying and stowing. The strap 14 has an adjustable loop 15 that is adjustable typically for the person throwing the bag 10 to grip the end or securing around his/her wrist. Tightening the adjustable loop is accomplished with sliding loop 33 that wraps around the adjustable loop 15 strap and tightening loop 77 that shares a common strap with the adjustable loop 15 and threads inside sliding loop 33. Deployment of the bag is illustrated in FIG. 11 showing the throwing person 21 to the incapacitated person 22. The bag 10 is attached to the incapacitated person 22 using the spring hook 17. In order to block the strap 14 from sliding inside the bag 10, the strap 14 is enlarged at the two ends of the grommet 18. This may be accomplished by doubling up of the strap 14, sewing a blocking segment, e.g., a short segment of a strap onto the long rescue strap 14 one on the inside of the bag 31 and one on the outside 32.

It should be understood, of course, that the foregoing relates to exemplary embodiments of the invention and that modifications may be made without departing from the spirit and scope of the invention.

I claim:

1. A device for moving incapacitated persons comprising:

a receptacle having an inside and an outside, said receptacle having a top opening, said receptacle having opening and closing means, said receptacle also having a sidewall containing an aperture;

a rescue line comprising a rescue strap, said rescue strap having a first end and a second end, said rescue line being adapted for folding, winding, unwinding and placing on the inside of the receptacle, said first end of the rescue line being formed into an adjustable loop, said second end of the rescue line being threaded through the aperture from the inside of the receptacle; and a second loop being attached to said second end of said rescue line, said second loop comprising a spring hook;

said rescue strap containing an inner blocking member attached to said rescue strap on a portion of said rescue strap disposed on the inside of said receptacle in a proximity to the aperture;

said inner blocking member comprising an added strap section sewn onto the rescue strap.

2. The device of claim 1 further containing an outer blocking member attached to said rescue strap on a portion of said rescue strap disposed on the outside of said receptacle in a proximity to the aperture and the spring hook, said outer blocking member comprises an added strap section sewn onto the rescue strap.

3. The device of claim 1 further comprising a tightening loop formed by an extension of an end strap of the adjustable loop and a sliding loop wrapped around the rescue strap formed by the end strap of the adjustable loop.

4. A method for moving an incapacitated person comprising:

providing a device for moving incapacitated persons, said device comprising a receptacle, said receptacle having an inside and an outside and a top opening, said receptacle also having a flap for opening and closing the device, said receptacle having a sidewall containing an aperture, said device comprising a rescue line having a first end and a second end, said rescue line being adapted for folding, winding, unwinding and placing on the inside of the receptacle, said first end of the rescue line being formed into a tightening loop, a sliding loop and an adjustable loop, said second end of the rescue line being threaded through the aperture from the inside of the receptacle, said rescue line also containing a second loop being attached to said second end of said rescue line, said device also comprising a draw string for tightening the top opening;

with the rescue line wound inside the receptacle, opening the flap and loosening the draw string;

pulling out the adjustable loop from the receptacle;

wrapping the adjustable loop around a substantially fixed object;

adjusting the tightening loop and the sliding loop to tighten the adjustable loop around the fixed object;

with the adjustable loop wrapped around the substantially fixed object, throwing the receptacle containing the wound rescue line toward the incapacitated person;

unwinding the rescue line from the bag;

when the receptacle reaches the incapacitated person, attaching the second loop to the incapacitated person; and pulling the incapacitated person to a secure area.

5. The method of claim 4, wherein the substantially fixed object comprises a person's wrist.

6. The method of claim 5, wherein the second loop attaches to a casualty strap of the incapacitated person.

7. The method of claim 4, wherein the second loop attaches to an ankle of the incapacitated person.

8. The method of claim 4, wherein the second loop comprises a spring hook.

9. The method of claim 4, wherein the aperture comprises a grommet.

10. The method of claim 4, wherein the rescue line comprises a rescue strap.

11. The method of claim 4, wherein the substantially fixed object comprises a fixed post.

* * * * *